US007071890B2

(12) United States Patent
Tanaka et al.

(10) Patent No.: US 7,071,890 B2
(45) Date of Patent: Jul. 4, 2006

(54) REFLECTOR

(75) Inventors: Masato Tanaka, Koganei (JP); Kyouichi Iigusa, Kyoto (JP); Takashi Ohira, Kyoto (JP)

(73) Assignee: National Institute of Information and Communications Technology, Incorporated Administrative Agency, Tokyo (JP)

( * ) Notice: Subject to any disclaimer, the term of this patent is extended or adjusted under 35 U.S.C. 154(b) by 0 days.

(21) Appl. No.: 10/527,041

(22) PCT Filed: Sep. 9, 2002

(86) PCT No.: PCT/JP02/09180

§ 371 (c)(1),
(2), (4) Date: Nov. 14, 2005

(87) PCT Pub. No.: WO2004/023602

PCT Pub. Date: Mar. 18, 2004

(65) Prior Publication Data

US 2006/0097942 A1 May 11, 2006

(51) Int. Cl.
*H01Q 15/12* (2006.01)

(52) U.S. Cl. ..... 343/756; 343/770; 343/771

(58) Field of Classification Search ..... 343/756, 343/767, 770, 771, 753, 755, 909; H01Q 15/12
See application file for complete search history.

(56) References Cited

U.S. PATENT DOCUMENTS

| | | | | |
|---|---|---|---|---|
| 5,638,079 | A * | 6/1997 | Kastner et al. | 343/770 |
| 6,509,881 | B1 * | 1/2003 | Falk | 343/771 |
| 6,529,174 | B1 * | 3/2003 | Stjernman et al. | 343/909 |
| 6,977,621 | B1 * | 12/2005 | Kelly et al. | 343/771 |
| 6,995,724 | B1 * | 2/2006 | Teshirogi et al. | 343/771 |

FOREIGN PATENT DOCUMENTS

| | | | |
|---|---|---|---|
| JP | 53-097392 | A | 8/1978 |
| JP | 56006712 | B | 2/1981 |
| JP | 05-142332 | A | 6/1993 |
| JP | 2002-185237 | A | 6/2002 |

* cited by examiner

*Primary Examiner*—Hoanganh Le

(74) *Attorney, Agent, or Firm*—Westerman, Hattori, Daniels & Adrian, LLP.

(57) ABSTRACT

A reflector includes a pair or plural pairs of array antennas. Each array antenna is formed of an arrangement of a plurality of antenna elements formed on a surface of a waveguide. The array antennas are placed parallel to each other. Both ends of each array antenna pair are connected through a pair of waveguides. Information adding devices are inserted in the waveguides.

15 Claims, 8 Drawing Sheets

REFLECTOR

TECHNICAL FIELD

The present invention relates to a reflector that radiates an incident electromagnetic wave in the same direction as the direction of incidence.

BACKGROUND ART

Reflecting an electromagnetic wave at a reflector plate in the same direction as the direction of incidence requires that the reflector plate be placed perpendicular to the incidence direction of the electromagnetic wave. Accordingly, when an electromagnetic wave is incident upon the reflector plate from an arbitrary direction, it is not possible to reflect the electromagnetic wave in the same direction as the incidence direction.

Then, it is supposed that combining a plurality of reflector plates will allow an electromagnetic wave incident from an arbitrary direction to be reflected in the same direction as the incidence direction.

However, with this method, the state of polarization of the incident electromagnetic wave cannot be varied. For example, when the incident wave is a linearly polarized wave, the state of polarization is preserved between the incident wave and the reflected wave. In this case, it is not possible to make the direction of polarization of the reflected wave different from the direction of polarization of the incident wave.

Also, when the incident wave is a circularly polarized wave, the reflected wave is a circularly polarized wave whose direction of rotation is opposite to that of the incident wave. In this case, it is not possible to make the direction of rotation of the reflected circularly polarized wave coincide with the direction of rotation of the incident circularly polarized wave.

Accordingly, when an electromagnetic wave is transmitted to a reflector plate, the electromagnetic wave reflected at the reflector plate may not be distinguishable from other electromagnetic waves. It is therefore desired that the state of polarization of the reflected wave can be arbitrarily varied from that of the incident wave.

Also, it is not possible to add information to a received electromagnetic wave by combining conventional reflector plates.

DISCLOSURE OF THE INVENTION

An object of the present invention is to provide a reflector that is capable of radiating an incident electromagnetic wave in the same direction as the direction of incidence and also capable of varying the state of polarization.

Another object of the present invention is to provide a reflector that is capable of radiating an incident electromagnetic wave in the same direction as the direction of incidence and also capable of adding information to the incident electromagnetic wave.

According to a first aspect of the invention, a reflector includes a first array antenna that is formed of an arrangement of a plurality of first antenna elements, a second array antenna that is placed approximately parallel with the first array antenna and formed of an arrangement of a plurality of second antenna elements, a first propagation path that connects one end of the first array antenna and one end of the second array antenna to propagate an electromagnetic wave, and a second propagation path that connects the other end of the first array antenna and the other end of the second array antenna to propagate an electromagnetic wave.

In the reflector of the invention, when an electromagnetic wave from a certain direction is incident to the plurality of first antenna elements of the first array antenna, the electromagnetic wave propagates in the first propagation path and is radiated from the plurality of second antenna elements of the second array antenna in the same direction as the direction of incidence.

In this case, it is possible to make the state of polarization varied between the incident wave and the reflected wave by properly setting the directions and types of the plurality of first antenna elements and the plurality of second antenna elements.

The plurality of first antenna elements of the first array antenna and the plurality of second antenna elements of the second array antenna may be provided to transmit and receive different polarized waves.

Then, when the plurality of first antenna elements receive a linearly polarized wave, a linearly polarized wave of a different direction is transmitted from the plurality of second antenna elements. Also, when the plurality of second antenna elements receive a linearly polarized wave, a linearly polarized wave of a different direction is transmitted from the plurality of first antenna elements.

The plurality of first antenna elements and the plurality of second antenna elements may be provided to transmit and receive linearly polarized waves of different directions.

In this case, upon reception of a linearly polarized wave, it is possible to transmit back a linearly polarized wave of a different direction.

The plurality of first antenna elements may include a plurality of first inclined slots, the plurality of second antenna elements may include a plurality of second inclined slots, and the plurality of first inclined slots and the plurality of second inclined slots may be arranged in different directions.

In this case, upon reception of a linearly polarized wave, it is possible to transmit back a linearly polarized wave of a different direction.

Each of the plurality of first and second antenna elements may be a linear polarization antenna.

In this case, upon reception of a linearly polarized wave, it is possible to transmit back a linearly polarized wave of a different direction.

The plurality of first antenna elements of the first array antenna and the plurality of second antenna elements of the second array antenna may be provided to transmit and receive a same polarized wave.

In this case, upon reception of a circularly polarized wave, a signal received at the plurality of first antenna elements is transmitted from the plurality of second antenna elements as a circularly polarized wave of the same rotating direction, and a signal received at the plurality of second antenna elements is transmitted from the plurality of first antenna elements as a circularly polarized wave of the same rotating direction The plurality of first antenna elements and the plurality of second antenna elements may be provided to transmit and receive a circularly polarized wave and to propagate the received electromagnetic waves in a same direction.

In this case, upon reception of a circularly polarized wave, an electromagnetic wave received at the first antenna elements of the first array antenna is transmitted back from the second antenna elements of the second array antenna as a circularly polarized wave of the same rotating direction, and an electromagnetic wave received at the second antenna elements of the second array antenna is transmitted back from the first antenna elements of the first array antenna as a circularly polarized wave of the same rotating direction. The lengths of the first and second propagation paths may be set equal so that the two transmitted electromagnetic waves are in phase.

The plurality of first antenna elements may include a plurality of first inclined slot pairs, the plurality of second antenna elements may include a plurality of second inclined slot pairs, and the plurality of first inclined slot pairs and the plurality of second inclined slot pairs may be arranged in a same direction.

In this case, upon reception of a circularly polarized wave, it is possible to transmit back a circularly polarized wave of the same direction.

Each of the plurality of first and second antenna elements may be a circular polarization antenna.

In this case, upon reception of a circularly polarized wave, it is possible to transmit back a circularly polarized wave of the same direction.

The reflector may further include an information adding device that is provided in at least one of the first propagation path and the second propagation path and that adds information to the electromagnetic wave.

In this case, it is possible to add information to an incident electromagnetic wave while radiating the electromagnetic wave in the same direction as the direction of incidence.

According to another aspect of the invention, a reflector includes a plurality of array antenna pairs each formed of first and second array antennas arranged approximately parallel, wherein the first and second array antennas of each array antenna pair include a plurality of first and second antenna elements, respectively, and the reflector further includes a plurality of first propagation paths that respectively connect one-side ends of the first and second array antennas of the plurality of array antenna pairs to propagate electromagnetic waves, and a plurality of second propagation paths that respectively connect the other-side ends of the first and second array antennas of the plurality of array antenna pairs to propagate electromagnetic waves.

In the reflector of the invention, when an electromagnetic wave is incident from a certain direction to the plurality of array antenna pairs, the electromagnetic wave is received at the plurality of antenna elements of one of the array antennas. The electromagnetic wave propagates in one propagation path and is radiated from the plurality of antenna elements of the corresponding array antenna in the same direction as the direction of incidence.

In this case, it is possible to make the state of polarization arbitrarily varied between the incident wave and the reflected wave by properly setting the directions and types of the plurality of first antenna elements and the plurality of second antenna elements.

The plurality of array antenna pairs may have a guide wavelength shorter than a free-space wavelength and intervals between the plurality of first antenna elements and intervals between the plurality of second antenna elements may differ among the plurality of array antenna pairs.

This makes it possible to vary the wave angles of electromagnetic waves transmitted and received by the plurality of array antenna pairs. Then, by arranging array antenna pairs adjusted to all wave angles, it is possible to transmit electromagnetic waves incident from arbitrary directions respectively back into the same directions as the directions of incidence.

The plurality of array antenna pairs may have guide wavelengths longer than a free-space wavelength and a waveguide structure parameter may differ among the plurality of array antenna pairs.

This makes it possible to vary the wave angles of electromagnetic waves transmitted and received by the plurality of array antenna pairs. Then, by arranging array antenna pairs adjusted to all wave angles, it is possible to transmit electromagetic waves incident from arbitrary directions respectively back into the same directions as the directions of incidence.

Each of the plurality of first and second antenna elements may be a linear polarization antenna, and in each array antenna pair, the plurality of first antenna elements of the first array antenna and the plurality of second antenna elements of the second array antenna may be provided to transmit or receive linearly polarized waves of different directions.

In this case, upon reception of a linearly polarized wave, it is possible to transmit back a linearly polarized wave of a different direction.

Each of the plurality of first and second antenna elements may be a circular polarization antenna, and in each array antenna pair, the plurality of first antenna elements of the first array antenna and the plurality of second antenna elements of the second array antenna may be provided to propagate electromagnetic waves in a same direction when receiving a circularly polarized wave of a same rotating direction.

In this case, when a circularly polarized wave is received, an electromagnetic wave received at the first antenna elements of the first array antenna is transmitted back from the second antenna elements of the second array antenna as a circularly polarized wave of the same rotating direction, and an electromagnetic wave received at the second antenna elements of the second array antenna is transmitted back from the first antenna elements as a circularly polarized wave of the same rotating direction.

BEST MODE FOR CARRYING OUT THE INVENTION

Figure 1:
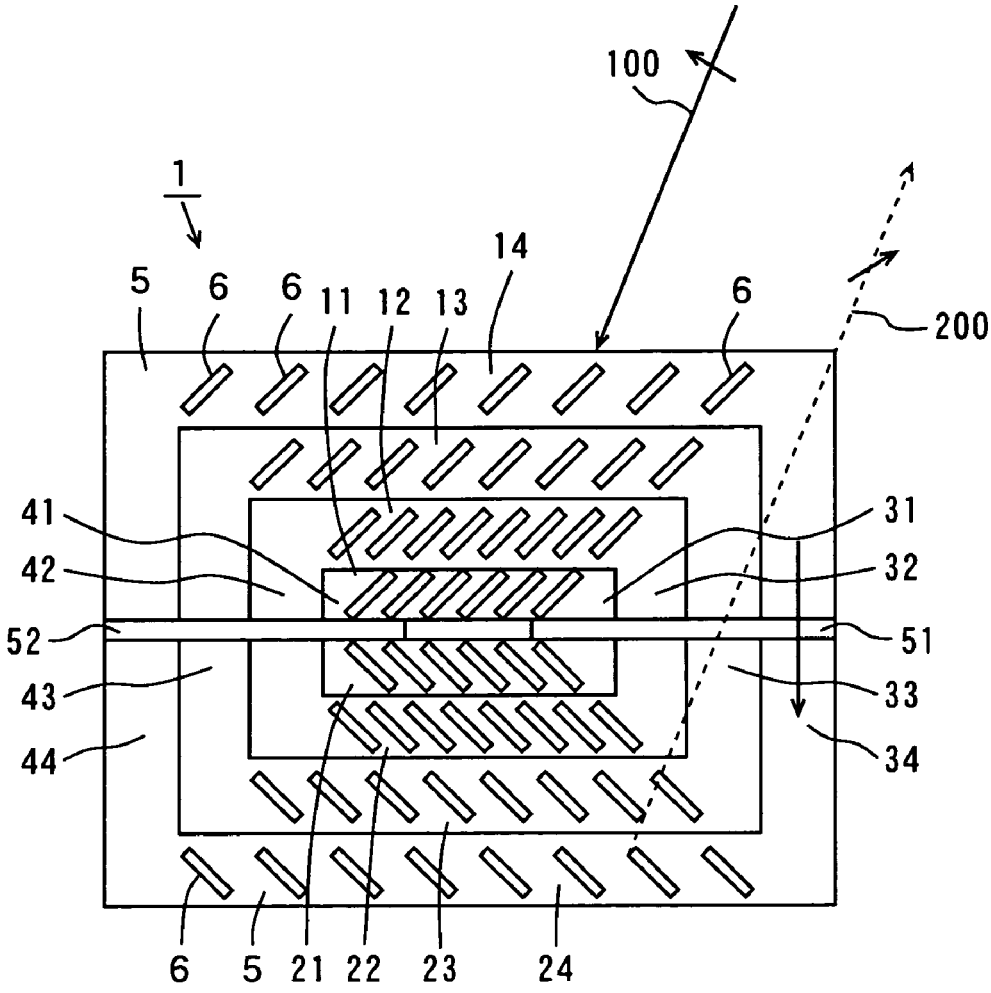
FIG. 1 is a plan view of a reflector according to an embodiment of the present invention.
Figure 2:
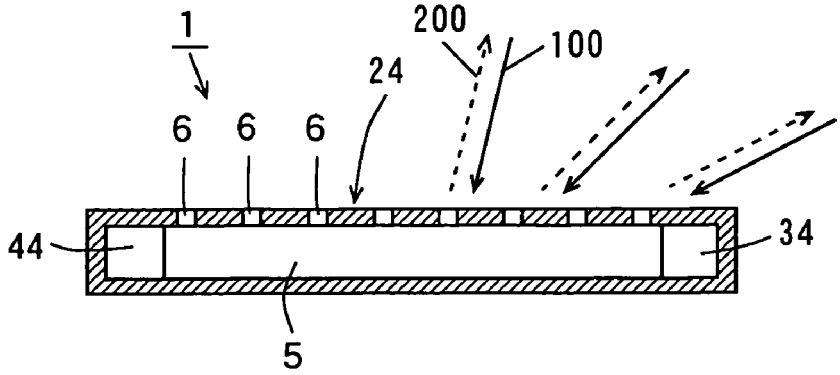
FIG. 2 is a cross-sectional view of the reflector of FIG. 1.

FIG. 1 is a plan view of a reflector according to an embodiment of the present invention. FIG. 2 is a cross-sectional view of the reflector of FIG. 1.

The reflector 1 of FIG. 1 has plural pairs of traveling-wave array antennas 11 to 14 and 21 to 24. Each of the array antennas 11 to 14 and 21 to 24 includes a plurality of antenna elements 6 arranged at equal intervals on a surface of a waveguide 5. In this embodiment, each antenna element 6 is formed of an inclined slot that produces a linear polarization.

As shown in FIG. 1, the array antennas 11 and 21 are placed parallel with each other, the array antennas 12 and 22 are placed parallel with each other outside of the array antennas 11 and 21, the array antennas 13 and 23 are placed parallel with each other outside of the array antennas 12 and 22, and the array antennas 14 and 24 are placed parallel with each other outside of the array antennas.

The antenna elements 6 of the pair of array antennas 11 and 21 are arranged in different directions. Similarly, the antenna elements 6 of the pair of array antennas 12 and 22 are arranged in different directions, the antenna elements 6 of the pair of array antennas 13 and 23 are arranged in different directions, and the antenna elements 6 of the pair of array antennas 14 and 24 are arranged in different directions.

Both ends of the array antennas 11 and 21 are connected through a pair of waveguides 31 and 41, both ends of the array antennas 12 and 22 are connected through a pair of waveguides 32 and 42, both ends of the array antennas 13 and 23 are connected through a pair of waveguides 33 and 43, and both ends of the array antennas 14 and 24 are connected through a pair of waveguides 34 and 44.

An information adding device 51 is inserted in the waveguides 31 to 34 and an information adding device 52 is inserted in the waveguides 41 to 44. The information adding devices 51 and 52 are components for adding information to electromagnetic waves propagating in the waveguides 31 to 34 and 41 to 44, or for amplifying the signals, which can be amplifiers, modulators/demodulators, phase shifters, isolators, waveguides, etc.

Figure 3:
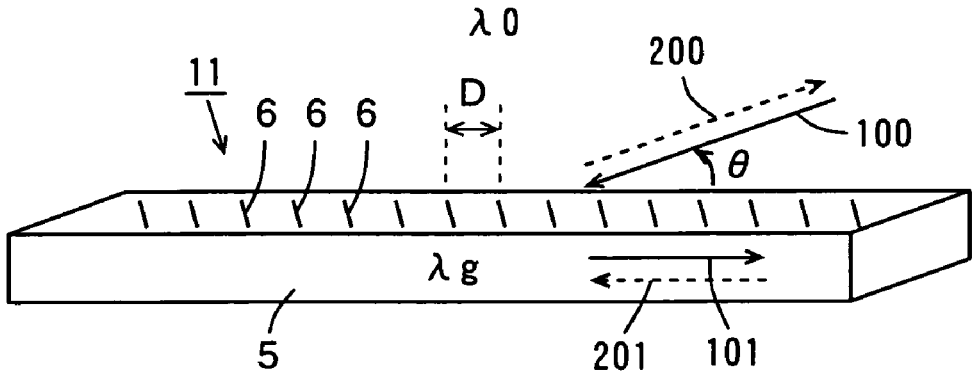
FIG. 3 is a perspective view used to describe an operation of a traveling-wave array antenna.
Figure 4:
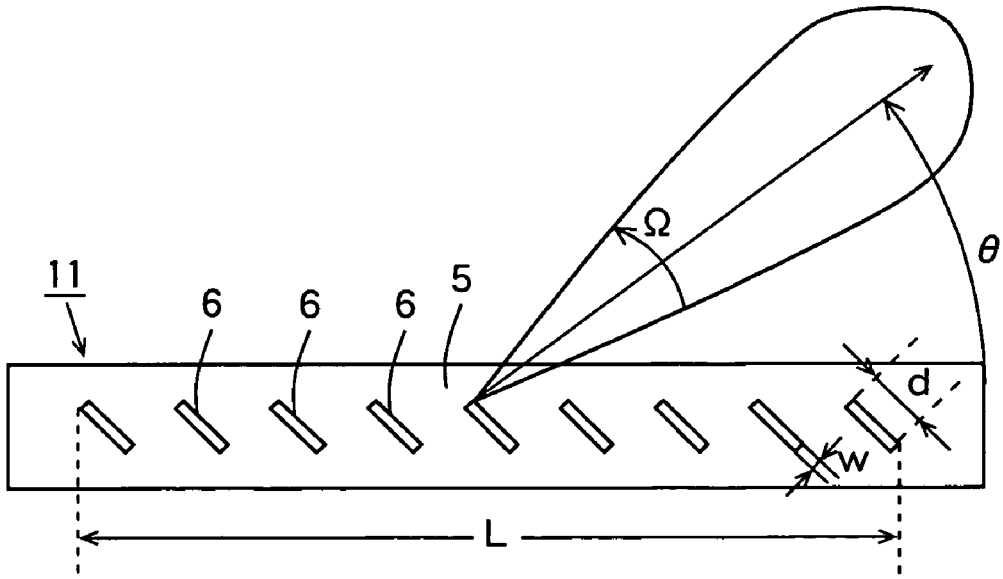
FIG. 4 is a plan view used to describe an operation of the traveling-wave array antenna.

Now, referring to FIGS. 3 and 4, the operation of a traveling-wave array antenna is described. FIG. 3 is a perspective view illustrating the operation of the traveling-wave array antenna and FIG. 4 is a plan view illustrating the operation of the traveling-wave array antenna.

With the antenna elements 6 of the array antenna 11 of FIGS. 3 and 4, suppose that an electromagnetic wave is incident at a wave angle θ as shown by arrow 100 and then the electromagnetic wave propagates in the waveguide 5 in the direction shown by arrow 101. Then, because of the reversibility of reception and transmission, when an electromagnetic wave propagates in the waveguide 5 in the direction shown by arrow 201, the antenna elements 6 radiate the electromagnetic wave at the wave angle θ as shown by arrow 200.

While FIG. 4 schematically shows the wave angle θ, the wave angle θ is actually an angle formed between the surface of the array antenna 11 and the direction of the electromagnetic wave in a plane normal to the surface of the array antenna 11.

Thus, when an electromagnetic wave is received and transmitted using same array antennas 11, the receiving direction and the transmitting direction coincide with each other. Accordingly, as shown in FIG. 1, when the pair of array antennas 11 and 21 are placed parallel and both their ends are connected through the waveguides 31 and 41, then the receiving direction of the array antenna 11 coincides with the transmitting direction of the array antenna 21, and the receiving direction of the array antenna 21 coincides with the transmitting direction of the array antenna 11. That is, it is possible to transmit a received electromagnetic wave in the same direction as the direction of reception.

Also, the pair of array antennas 12 and 22 are placed parallel and both their ends are connected through the waveguides 32 and 42, and so the receiving direction of the array antenna 12 coincides with the transmitting direction of the array antenna 22 and the receiving direction of the array antenna 22 coincides with the transmitting direction of the array antenna 12.

Similarly, the pair of array antennas 13 and 23 are placed parallel and both their ends are connected through the waveguides 33 and 43, and so the receiving direction of the array antenna 13 coincides with the transmitting direction of the array antenna 23 and the receiving direction of the array antenna 23 coincides with the transmitting direction of the array antenna 13.

Also, the pair of array antennas 14 and 24 are placed parallel and both their ends are connected through the waveguides 34 and 44, and so the receiving direction of the array antenna 14 coincides with the transmitting direction of the array antenna 24 and the receiving direction of the array antenna 24 coincides with the transmitting direction of the array antenna 14.

In the reflector 1 of FIG. 1, an electromagnetic wave incident to the array antennas 11 to 14 from a certain direction is received at antenna elements 6 of one of the array antennas 11 to 14, propagated in the waveguide 5, and further propagated in the corresponding one of the waveguides 31 to 34 or waveguides 41 to 44. During the propagation in the corresponding one of the waveguides 31 to 34 or waveguides 41 to 44, the information adding device 51 or 52 adds information to the electromagnetic wave. The electromagnetic wave further propagates in the waveguide 5 of the corresponding one of the array antennas 21 to 24, and then the antenna elements 6 radiate an electromagnetic wave having a different polarization from that of the incident wave, in the same direction as the direction of incidence. Electromagnetic waves incident to the array antennas 21 to 24 are transmitted back in the same manner.

In this case, the array antennas 11 to 14 and 21 to 24 are made so that they can receive and transmit electromagnetic waves at uniformly distributed wave angles θ, whereby electromagnetic waves incident from arbitrary directions can be reflected in the same directions as the direction of incidence.

Now, let the free-space wavelength of an electromagnetic wave be $\lambda 0$ and the guide wavelength be $\lambda g$. Also, the intervals between the antenna elements 6 of the array antenna are represented as D (which is hereinafter referred to simply as an element interval).

When $\lambda g<\lambda 0$, the traveling-wave array antenna is a surface-wave antenna, and when $\lambda g>\lambda 0$, it is a leaky-wave antenna.

When $\lambda g<\lambda 0$, the element interval D and the wave angle θ of a transmitted/received electromagnetic wave satisfy the relations of the expressions below:

$$D=X\lambda g \ldots \quad (1)$$

$$X=1/(1+\lambda g\cos\theta/\lambda 0) \ldots \quad (2)$$

As can be seen from these expressions, varying the element interval D in the array antenna varies the wave angle θ of the received/transmitted electromagnetic wave. Reducing the element interval D makes the wave angle θ smaller, and enlarging the element interval D makes the wave angle θ larger. The wave angle θ does not depend on the type of the antenna elements.

In the reflector 1 of FIG. 1, the array antennas 11 to 14 and 21 to 24 have different element intervals D. This enables reception and transmission at a plurality of wave angles θ.

When λg>λ0, the element interval D and the wave angle θ of a received/transmitted electromagnetic wave satisfy the relation of the expression below:

$$\cos\theta=\lambda 0/\lambda g \ldots \quad (3)$$

Thus, the wave angle θ does not depend on the element interval D. However, since the guide wavelength λg varies with waveguide structure parameters (the height and width of a section of a waveguide), it is possible to control the wave angle θ with the structural parameters.

Also, in the reflector 1 of FIG. 1, the antenna elements 6 of the array antennas 11 to 14 are arranged in a direction different from that of the antenna elements 6 of the array antennas 21 to 24, so that the direction of polarization of electromagnetic waves incident to the array antennas 11 to 14 differ from the direction of polarization of electromagnetic waves radiated from the array antennas 21 to 24.

Thus, the reflector 1 of FIG. 1 is capable of transmitting a reflected wave back in the same direction while varying the direction of polarization of the received incident wave.

Next, let the beam half-maximum angle be Ω and the gain of the beam be G. Also, let the array length be L (the length of the arrangement of a plurality of antenna elements of an array antenna).

Under uniform aperture approximation, the beam half-maximum angle Ω and the gain G satisfy the relations of the expressions below:

$$\Omega=50.8\lambda 0/L \ldots \quad (4)$$

$$G\sim 4\pi L/\lambda 0 \ldots \quad (5)$$

It is seen from expressions (4) and (5) that shortening the array length L enlarges the beam half-maximum angle Ω and reduces the gain G. When the number of antenna elements is fixed, shortening the array length L shortens the element interval D, and, in the case of a surface-wave antenna, it reduces the wave angle θ according to expressions (1) and (2). Thus, when the wave angle θ is varied with a fixed number of elements, then the gain G and the beam half-maximum angle Ω are varied, too.

For the purpose of keeping the beam half-maximum angle Ω and the gain G approximately constant, the array length L is fixed. According to expressions (1) and (2), the element interval D is shorter when the wave angle θ is smaller, and so the number, N, of antenna elements 6 should be increased. Then, as the number of elements is increased, the amounts of reception and transmission at each antenna element 6 should be reduced, and so the length d or the width w of the inclined slots of the antenna elements 6 is reduced.

When λg>λ0, the element interval D can be arbitrary and so the element interval D can be constant to keep the beam half-maximum angle Ω constant.

Figure 5:
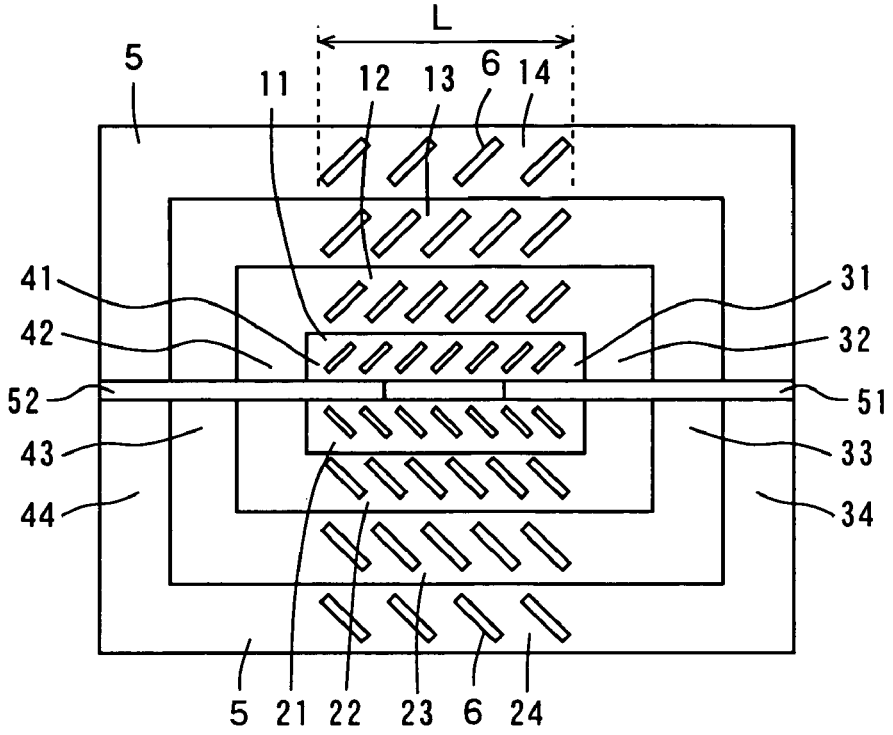
FIG. 5 is a schematic diagram showing an example arrangement of array antennas that provide fixed beam width and gain when $\lambda g<\lambda 0$.

FIG. 5 is a schematic diagram showing an example arrangement of array antennas that provide constant beam half-maximum angle and gain when λg<λ0.

When λg<λ0, as shown in FIG. 5, the array lengths L of the array antennas 11 to 14 and 21 to 24 are set equal, and the number of antenna elements 6 is reduced sequentially from the array antenna 11 to the array antenna 14 and reduced sequentially from the array antenna 21 to the array antenna 24. This makes it possible to increase the wave angle θ reception/transmission sequentially from the array antenna 11 to the array antenna 14 and sequentially from the array antenna 21 to the array antenna 24, while keeping the beam half-maximum angle Ω and the gain G constant.

Figure 6:
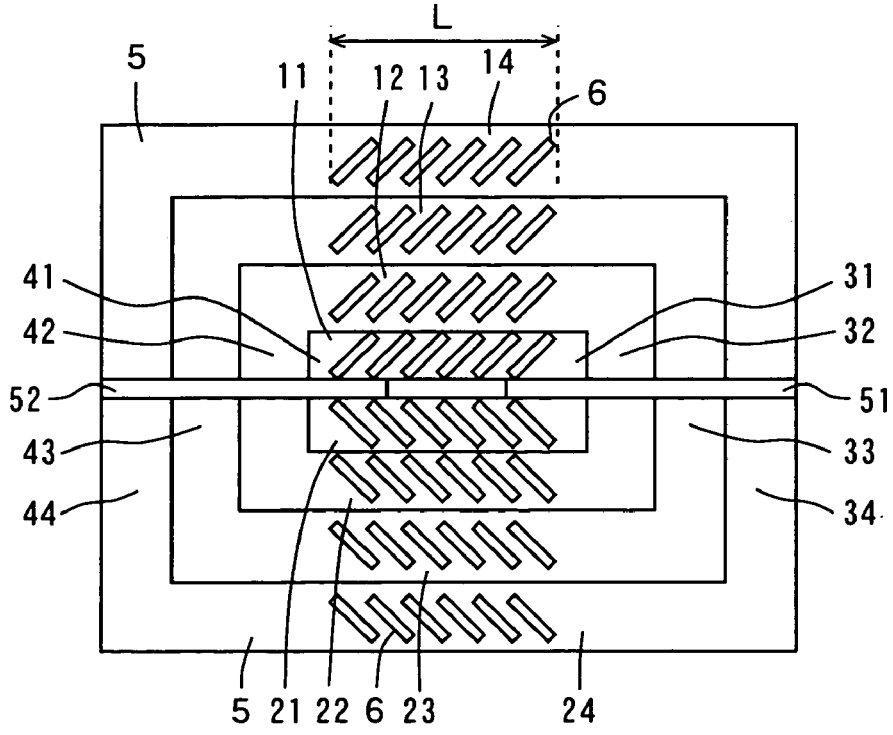
FIG. 6 is a schematic diagram showing an example arrangement of array antennas that provide fixed beam width and gain when $\lambda g<\lambda 0$.

FIG. 6 is a schematic diagram showing an example arrangement of array antennas providing constant beam half-maximum angle and gain when λg>λ0.

When λg>λ0, as shown in FIG. 6, the beam half-maximum angle Ω and the gain G can be set constant, with equal array lengths L of the array antennas 11 to 14 and 21 to 24 and equal numbers of antenna elements 6 of the array antennas 11 to 14 and 21 to 24. In this case, the waveguide structural parameters of the array antennas 11 to 14 and 21 to 24 are varied so that the receive/transmit wave angle θ becomes larger sequentially from the array antenna 11 to the array antenna 14 and also sequentially from the array antenna 21 to the array antenna 24.

Figure 7:
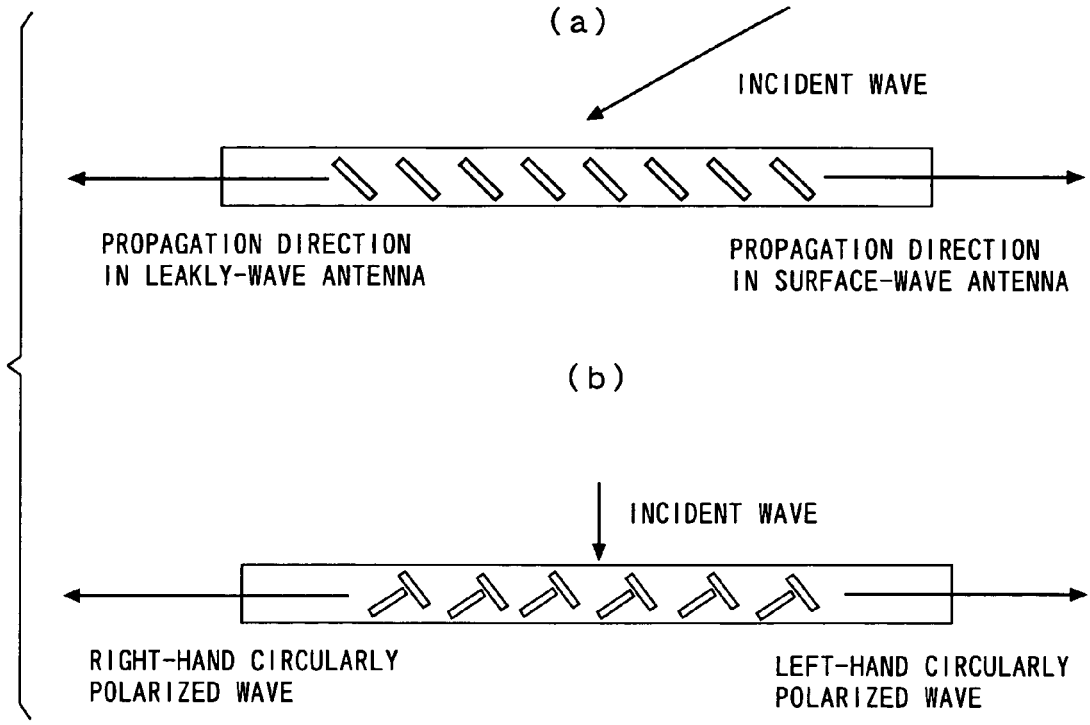
FIGS. 7(*a*) and 7(*b*) illustrate directions of propagation upon reception of a linearly polarized wave and a circularly polarized wave.

As shown in FIG. 7(*a*), upon reception of a linearly polarized wave, the direction of propagation in a leaky-wave antenna and the direction of propagation in a surface-wave antenna are opposite.

Also, as shown in FIG. 7(*b*), upon reception of a circularly polarized wave, the direction of propagation of a right-hand circularly polarized wave in the array antenna and that of a left-hand circularly polarized wave are opposite.

Figure 8:
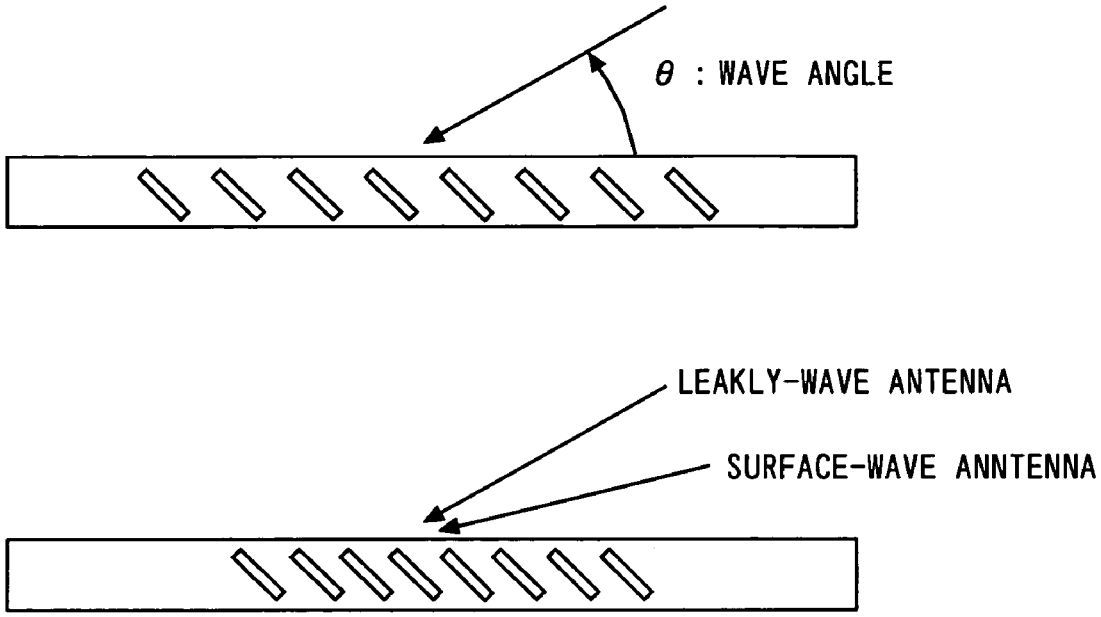
FIG. 8 illustrates a relation between element intervals and a wave angle.

As shown in FIG. 8, with a surface-wave antenna, shortening the element interval makes the wave angle θ smaller. On the other hand, with a leaky-wave antenna, the wave angle θ is unchanged even when the element interval is shortened.

Figure 9:
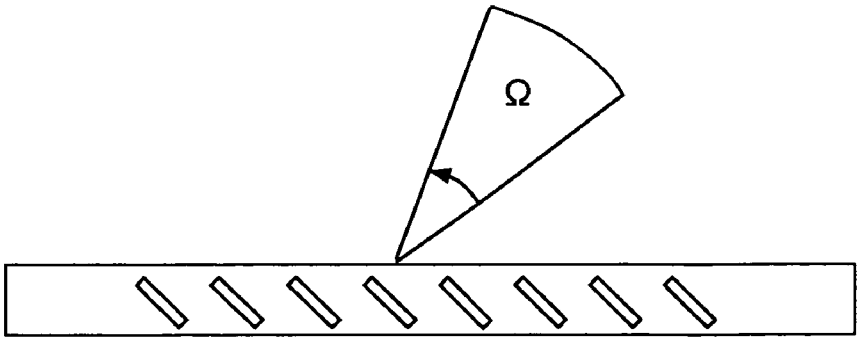
FIG. 9 is a diagram used to describe a relation between a beam half-maximum angle and array length.

As shown in FIG. 9, in both of leaky-wave and surface-wave antennas, the beam half-maximum angle Ω depends on the array length but not on the element interval.

Figure 10:
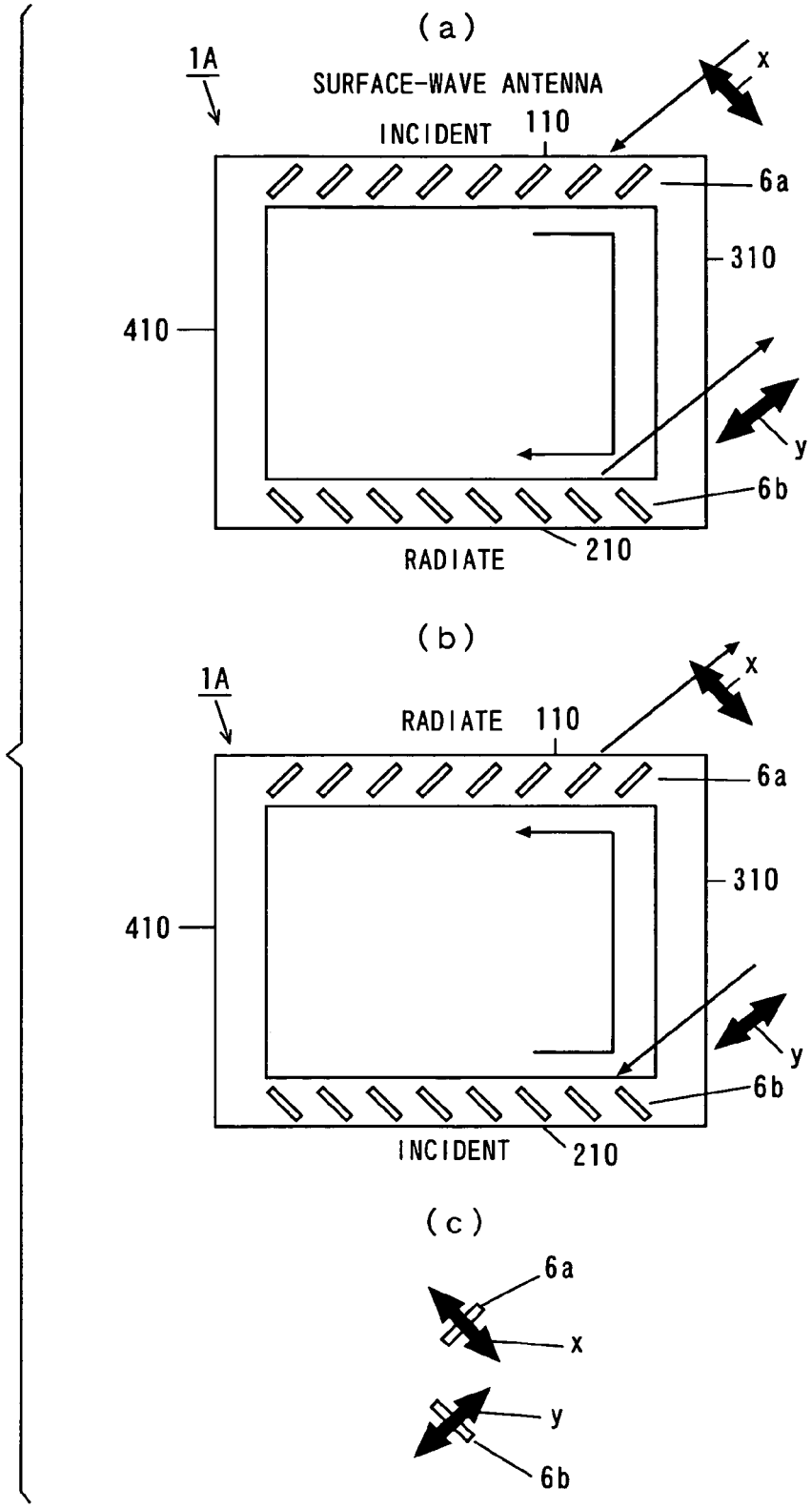
FIGS. 10(*a*), 10(*b*), and 10(*c*) illustrate reception and transmission of linearly polarized waves with a surface-wave antenna.

FIGS. 10(*a*), 10(*b*), and 10(*c*) illustrate reception and transmission of linearly polarized waves with a surface-wave antenna.

In FIGS. 10(*a*) and 10(*b*), a reflector 1A includes an array antenna 110 having a plurality of antenna elements 6*a* formed of inclined slots, an array antenna 210 having a plurality of antenna elements 6*b* formed of inclined slots, and waveguides 310 and 410.

As shown in FIG. 10(*a*), an electromagnetic wave having a polarization x is received at the antenna elements 6*a* of the array antenna 110, propagated in the waveguide 310, and radiated from the antenna elements 6*b* of the array antenna 210 as an electromagnetic wave having a polarization y.

As shown in FIG. 10(*b*), an electromagnetic wave having a polarization y is received at the antenna elements 6*b* of the array antenna 210, propagated in the waveguide 410, and radiated from the antenna elements 6*a* of the array antenna 110 as an electromagnetic wave having a polarization x.

In this way, upon incidence of a linearly polarized electromagnetic wave to the reflector 1A, the receiving array antenna and the radiating array antenna are switched depending on the direction of inclination of the polarization.

Figure 11:
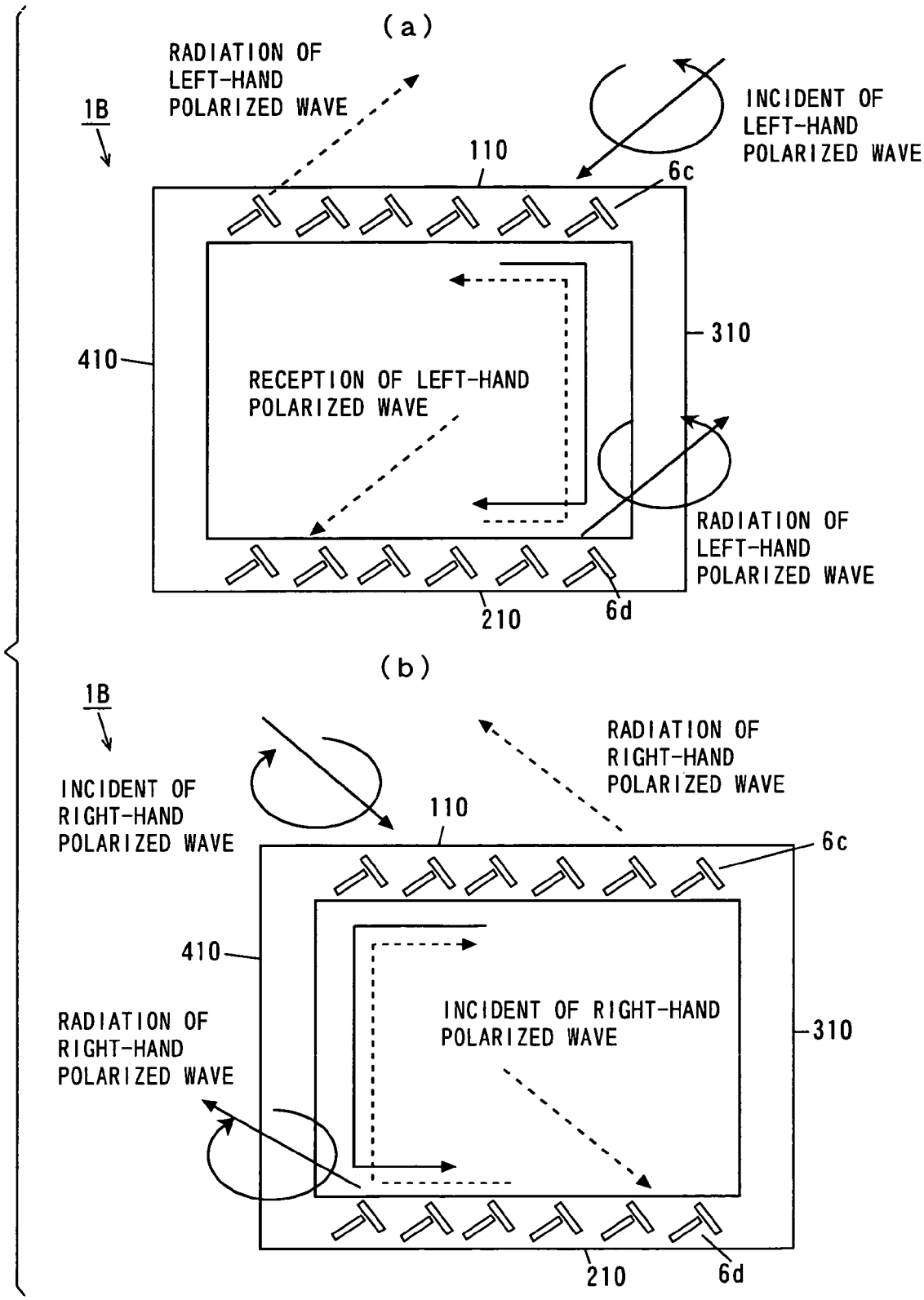
FIGS. 11(*a*) and 11(*b*) illustrate reception and transmission of circularly polarized waves.

FIGS. 11(*a*) and 11(*b*) illustrate reception and transmission of circularly polarized waves.

In FIGS. 11 (*a*) and 11(*b*), a reflector 1B includes an array antenna 110 having a plurality of antenna elements 6*c* formed of inclined slot pairs, an array antenna 210 having a plurality of antenna elements 6*d* formed of inclined slot pairs, and waveguides 310 and 410.

As shown in FIG. 11(*a*), a left-hand circularly polarized electromagnetic wave is received at the antenna elements 6*c* of the array antenna 110 and the antenna elements 6*d* of the array antenna 210. The left-hand circularly polarized electromagnetic wave received at the antenna elements 6*c* of the array antenna 110 is propagated in the waveguide 310 and radiated from the antenna elements 6*b* of the opposite array antenna 210. The left-hand circularly polarized electromagnetic wave received at the antenna elements 6*d* of the array antenna 210 is propagated in the waveguide 310 and radiated from the antenna elements 6*c* of the array antenna 110.

As shown in FIG. 11(*b*), a right-hand circularly polarized electromagnetic wave is received at the antenna elements 6*c* of the array antenna 110 and the antenna elements 6*d* of the array antenna 210. The right-hand circularly polarized electromagnetic wave received at the antenna elements 6*c* of the array antenna 110 is propagated in the waveguide 410 and radiated from the antenna elements 6*d* of the array antenna 210. The right-hand circularly polarized electromagnetic wave received at the antenna elements 6*d* of the array antenna 210 is propagated in the waveguide 410 and radiated from the antenna elements 6*c* of the array antenna 110.

As above, upon reception of a circularly polarized electromagnetic wave, the direction of propagation varies depending on the direction of rotation of the polarization. In this case, at the same time when the antenna elements 6*c* and 6*d* of the array antennas 110 and 210 receive the electromagnetic waves, the antenna elements 6*d* and 6*c* of the opposite array antennas 210 and 110 radiate the propagated waves.

While the reflector 1 of the embodiment includes four pairs of array antennas 11 to 14 and 21 to 24, the invention is not limited to this embodiment. The reflector 1 may include an arbitrary number of, one or more, pair or pairs of array antennas.

Figure 12:
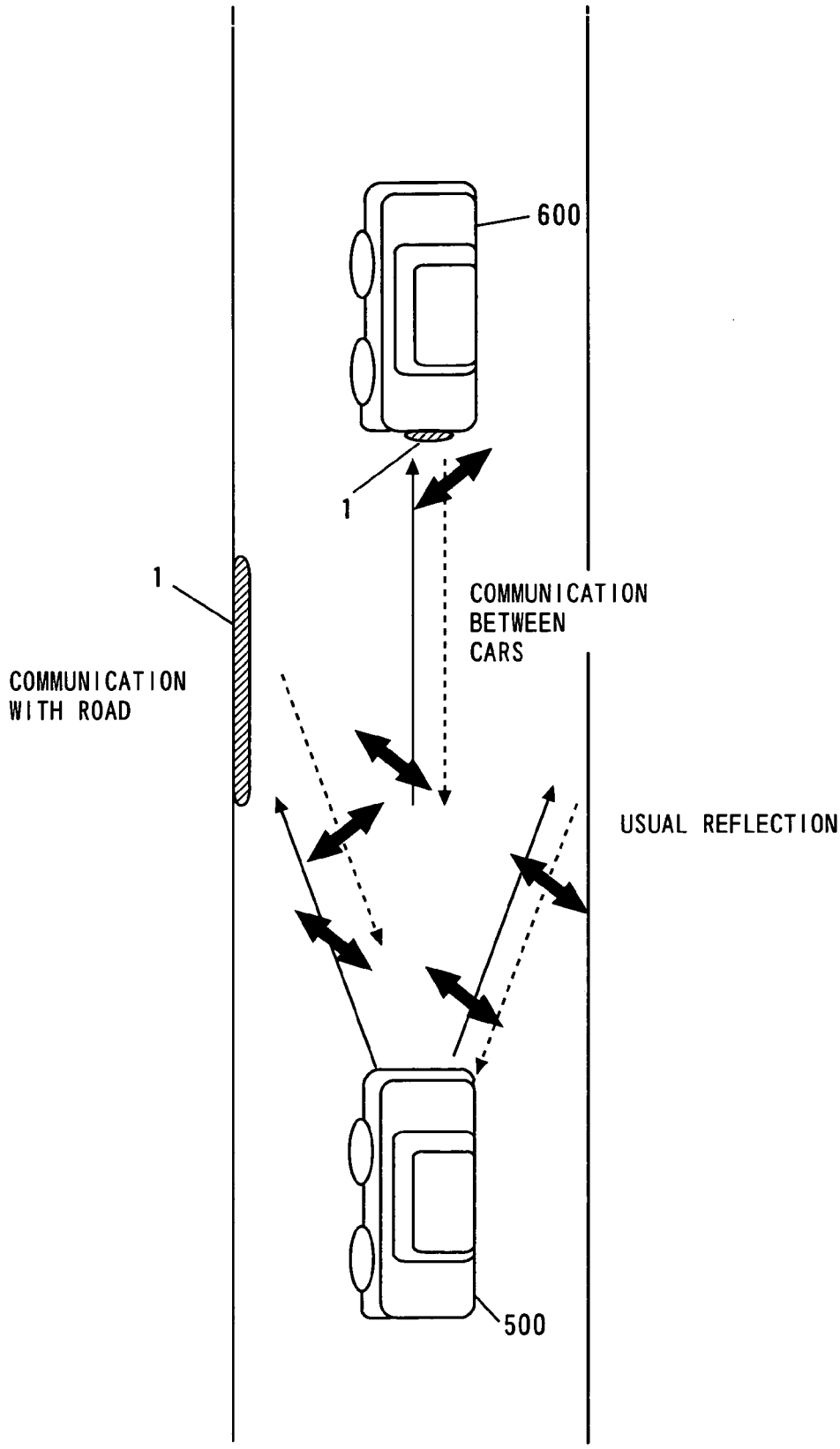
FIG. 12 is a schematic diagram showing examples of application of the reflector of FIG. 1.

FIG. 12 is a schematic diagram showing an application of the reflector 1 of FIG. 1. In the example of FIG. 12, the reflectors 1 each receive an electromagnetic wave sent from a car 500, add information to the electromagnetic wave, vary the state of polarization, and transmit it back in the same direction. In this case, the car 500 can receive information from the reflectors 1 by transmitting electromagnetic waves to the reflectors 1. In this process, it is possible to recognize that the reflected wave is not from a common object but from the reflector 1 because the polarization of the reflected wave is varied.

For example, when the reflector 1 is applied to a collision avoidance radar using oblique polarization, the reflector 1 can be attached to a car 600 running ahead and add various information to the reflected wave.

Also, reflectors 1 may be attached to guardrails of a road at constant intervals, with information providing devices connected to the reflectors 1 to provide various information, such as road traffic information. Then, when the running car 500 transmits an electromagnetic wave to the reflector 1, it can receive a reflected wave irrespective of the angle of incidence upon the reflector 1, thus receiving various information, like road traffic information, while running.

In this way, communication can be made between the car 500 and the road. Also, communication can be made between the car 500 and the car 600 running ahead.

While the array antennas 11 to 14 and 21 to 24 of the above described embodiment are formed of the waveguide 5, the invention is not limited to this embodiment. For example, array antennas may be formed of series-feed microstrip array antennas using microstrip lines instead of waveguides. Microstrip lines form surface-wave antennas since $\lambda g<\lambda 0$.

Also, while the array antennas 11 to 14 and 21 to 24 of the above described embodiment are formed of the inclined slot antenna elements 6, the invention is not limited to the embodiment. For example, antenna elements formed of pairs of oppositely inclined (/ \-shaped) slots producing circular polarization may be used. In this case, upon reception of a circularly polarized wave, it is possible to reflect, in the same direction as the incidence direction, a circularly polarized wave of the same rotating direction, so that the reflected signal is recognizable.

Also, the antenna elements may be formed of various kinds of antennas, such as spiral antennas, microstrip antennas, helical antennas, and so on.

Also, while the waveguides 31 to 34 and 41 to 44 are used in the embodiment as propagation paths connecting both ends of the array antennas 11 to 14 and 21 to 24, the invention is not limited to the embodiment. Other propagation paths, such as microstrip lines, flexible cables, etc. may be used.

What is claimed is:

1. A reflector comprising:

a first array antenna that is formed of an arrangement of a plurality of first antenna elements;

a second array antenna that is placed approximately parallel with said first array antenna and formed of an arrangement of a plurality of second antenna elements;

a first propagation path that connects one end of said first array antenna and one end of said second array antenna to propagate an electromagnetic wave; and a second propagation path that connects the other end of said first array antenna and the other end of said second array antenna to propagate an electromagnetic wave.

2. The reflector according to claim 1, wherein said plurality of first antenna elements of said first array antenna and said plurality of second antenna elements of said second array antenna are provided to transmit and receive different polarized waves.

3. The reflector according to claim 2, wherein said plurality of first antenna elements and said plurality of second antenna elements are provided to transmit and receive linearly polarized waves of different directions.

4. The reflector according to claim 3, wherein said plurality of first antenna elements include a plurality of first inclined slots, said plurality of second antenna elements include a plurality of second inclined slots, and said plurality of first inclined slots and said plurality of second inclined slots are arranged in different directions.

5. The reflector according to claim 3, wherein each of said plurality of first and second antenna elements is a linear polarization antenna.

6. The reflector according to claim 1, wherein said plurality of first antenna elements of said first array antenna and said plurality of second antenna elements of said second array antenna are provided to transmit and receive a same polarized wave.

7. The reflector according to claim 5, wherein said plurality of first antenna elements and said plurality of second antenna elements are provided to transmit and receive a circularly polarized wave and to propagate the received electromagnetic waves in a same direction.

8. The reflector according to claim 6, wherein said plurality of first antenna elements include a plurality of first inclined slot pairs, said plurality of second antenna elements include a plurality of second inclined slot pairs, and said plurality of first inclined slot pairs and said plurality of second inclined slot pairs are arranged in a same direction.

9. The reflector according to claim 6, wherein each of said plurality of first and second antenna elements is a circular polarization antenna.

10. The reflector according to claim 1, further comprising an information adding device that is provided in at least one of said first propagation path and said second propagation path and that adds information to the electromagnetic wave.

11. A reflector comprising:

a plurality of array antenna pairs each comprising first and second array antennas arranged approximately parallel, said first and second array antennas of each said array antenna pair comprising a plurality of first and second antenna elements, respectively;

a plurality of first propagation paths that respectively connect one-side ends of said first and second array antennas of said plurality of array antenna pairs to propagate electromagnetic waves; and a plurality of second propagation paths that respectively connect the other-side ends of said first and second array antennas of said plurality of array antenna pairs to propagate electromagnetic waves.

12. The reflector according to claim 11, wherein said plurality of array antenna pairs have guide wavelengths shorter than a free-space wavelength and intervals between said plurality of first antenna elements and intervals between said plurality of second antenna elements differ among said plurality of array antenna pairs.

13. The reflector according to claim 11, wherein said plurality of array antenna pairs have a guide wavelength longer than a free-space wavelength and a waveguide structure parameter differs among said plurality of array antenna pairs.

14. The reflector according to claim 11, wherein each of said plurality of first and second antenna elements is a linear polarization antenna, and in each said array antenna pair, said plurality of first antenna elements of said first array antenna and said plurality of second antenna elements of said second array antenna are provided to transmit or receive linearly polarized waves of different directions.

15. The reflector according to claim 12, wherein each of said plurality of first and second antenna elements is a circular polarization antenna, and in each said array antenna pair, said plurality of first antenna elements of said first array antenna and said plurality of second antenna elements of said second array antenna are provided to propagate electromagnetic waves in a same direction when receiving a circularly polarized wave of a same rotating direction.

* * * * *